United States Patent [19]

Ruis

[11] Patent Number: 4,821,758

[45] Date of Patent: Apr. 18, 1989

[54] TURBINE PLANT INTAKE HOUSING

[75] Inventor: Jean-Pierre Ruis, Le Chatelet en Brie, France

[73] Assignee: Societe Nationale d'Etude et de Construction de Moteurs D'Aviation "S.N.E.C.M A.", Paris, France

[21] Appl. No.: 124,604

[22] Filed: Nov. 24, 1987

[30] Foreign Application Priority Data

Nov. 26, 1986 [FR] France ..... 86 16449

[51] Int. Cl.[4] ..... F02C 7/04

[52] U.S. Cl. ..... 137/15.1; 244/53 B

[58] Field of Search ..... 137/15.1, 15.2; 244/53 B

[56] References Cited

U.S. PATENT DOCUMENTS 2,807,433 9/1957 Halford et al. .
3,224,666 12/1965 Ljungstrom et al. .
3,990,810 11/1976 Amos et al. .

FOREIGN PATENT DOCUMENTS 57426 1/1953 France .
774501 5/1957 United Kingdom .
1023766 3/1966 United Kingdom .

*Primary Examiner*—Alan Cohan
*Attorney, Agent, or Firm*—Oblon, Fisher, Spivak, McClelland & Maier

[57] ABSTRACT

A turbine plant intake housing includes an outer shell supporting radially extending arms which include a fixed part and a movable flap associated therewith. Each arm is provided with a metal tie rod having its radially outer end fixed between two forks supported by the outer shell, and its radially inner end co-operating with a metal insert embedded in layers of coiled filaments of composite material forming a floating hub supported by the tie rods. The radially inner end of each rod is attached to the insert of the hub by use of a nut which effects a prestressing clamping of the tie rod on assembly.

5 Claims, 3 Drawing Sheets

TURBINE PLANT INTAKE HOUSING

BACKGROUND OF THE INVENTION

1. Field of the Invention

The present invention relates to an air intake housing of a twin flow turbine plant, the housing being of the type mounted in cantilever fashion without a support bearing comprising an outer shell and a plurality of arms which extend radially between the outer shell and an inner hub and each of which comprises a fixed part and an associated adjustable flap.

2. Summary of the Prior Art

French patent publication Nos. 2,599,086 and 2,599,785 show examples of the mounting of an intake housing of this kind, and describe more particularly constructions of the control arrangement for the flaps.

In operation of a construction of this type, substantial aerodynamic stresses develop and act upon the movable flaps. Moreover, the search to reduce mass, which is particularly desirable in aeronautical applications, and recent developments of new materials, have lead to the possibility of making the arms of the housing and the hub to which they are connected from composite materials.

SUMMARY OF THE INVENTION

The invention seeks to permit these choices of materials and to compensate for the aerodynamic stresses exerted on the movable flaps of the arms by the employment of means for absorbing these stresses.

These results are achieved, according to the invention, by providing a turbine plant intake housing of the kind hereinbefore described in which each of the arms includes a metal tie rod forming a central core and disposed between said inner hub and said outer shell, and a nut fixing said tie rod to said inner hub whereby said tie rod is prestressed by the tightening of said nut.

Other features and advantages of the invention will become clear from the following description of one embodiment of the invention with reference to the attached drawings.

DESCRIPTION OF THE PREFERRED EMBODIMENT

Figure 1:
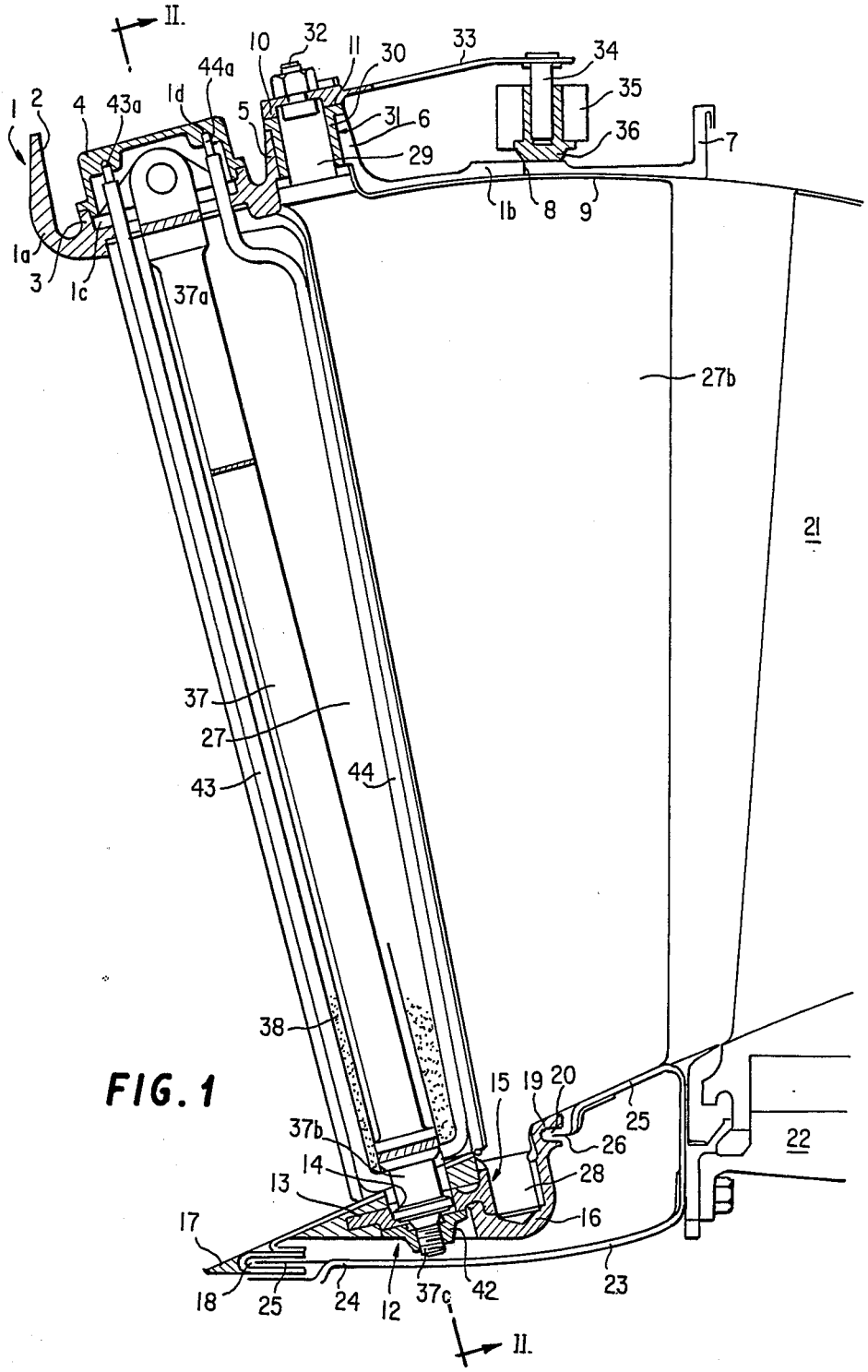
FIG. 1 is a longitudinal section through a part of one example of a turbine plant intake housing in accordance with the invention, taken in a plane passing through the axis of rotation of the turbine plant.
Figure 2:
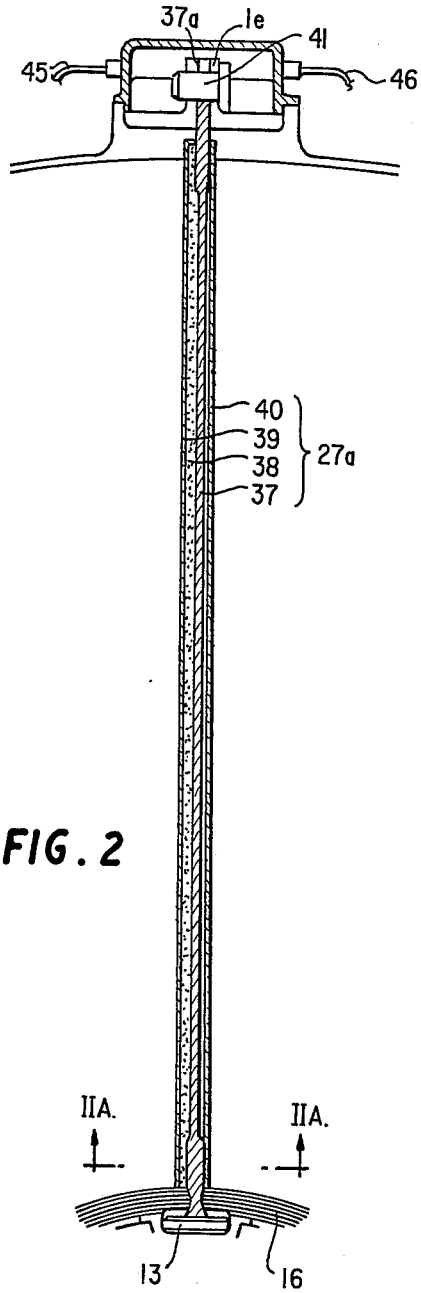
FIG. 2 is a cross-section through one of the arms of the intake housing, taken along line II—II in FIG. 1.
Figure 2A:
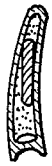
FIG. 2A is a cross section taken along line IIA—IIA of FIG. 2.

The turbine plant intake housing constructed in accordance with the invention and shown in FIGS. 1 and 2 has an outer shell 1 formed by an upstream annular member 1*a* and a downstream annular member 1*b*, upstream and downstream being defined relative to the main direction of flow of the gases in the turbine plant.

The upstream annular member 1*a* has an upstream flange 2 and a peripheral array of evenly distributed bosses 3, each boss 3 being covered by a cap 4. On its radially inner face the upstream annular member 1*a* has a recess 1*c* at the bottom of which there is a cut-out 1*d* which extends over the outer face between two forks 1*e*.

The upstream annular member 1*a* is rigidly connected to the downstream annular member 1*b* by means of two flanges 5 and 6 respectively. At the connecting plane between the upstream and downstream annular members 1*a*, 1*b*, each member has a peripheral array of semi-cylindrical bosses 10 and 11 respectively, which are evenly distributed and co-operate with each other to form cylindrical bores 31.

The downstream member 1*b* also has a downstream flange 7, and an annular outer surface 8. At the flange 7 connection is made to a flange of an adjacent casing. The inner wall 9 of the downstream annular member 1*b* is part spherical in shape for reasons which will be explained later.

At its radially inner side, the intake housing is associated with a hub 12 provided with a plurality of metal inserts 13 each having two radial bores, one in an upstream position 14 and the other in a downstream position 15. The inserts 13 are embedded in layers 16 of coiled filaments of a composite material, as may be seen, for example, in FIG. 2. The upstream edge 17 of the hub 12 forms an annular lip in which a groove 18 is provided, open towards the rear. Similarly, the downstream edge 19 of the hub also has a groove 20 which is open towards the rear.

Downstream of the intake housing the turbine plant has a rotary compression rotor stage of which one blade 21 and the disc 22 are partly shown in FIG. 1. Fixed to the disc 22 is a rotary inner cover 23 located inside the hub 12. The inner cover 23 has an upstream edge 24 which carries a sealing blade 25 engaged in the groove 18 of the hub 12 and a downstream edge 25 which carries a sealing blade 26 engaged in the groove 20 of the hub.

Between the outer shell 1 and the inner hub 12 a plurality of radially extending arms 27 are mounted, and in the embodiment illustrated there are sixteen of the arms 27. Each of these arms 27 consists of an upstream fixed part 27*a* and a downstream movable part forming a movable airfoil shaped flap 27*b*.

Each movable flap 27*b* has a radially inner pivot 28 rotatably mounted in the downstream bore 15 of one of the inserts 13 of the hub 12, and a radially outer pivot 29, which may be provided with a bush 30, received in one of the bores 31 formed by the half-bosses 10 and 11 of the outer shell 1. At the head of each outer pivot 29 there is fixed, for example by means of a bolt 32, one end of a lever 33 connected at its other end, by means of a pin 34, to a ring 35 for the control and synchronization of the movable flaps 27*b*. Actuating means of known type, e.g. a jack (not shown in the drawing) are associated with the control ring 35. The pins 34 are housed in a support 36 which rests and slides on the surface 8 of the downstream annular member 1*b*. When the movable flaps 27*b* are deflected, a minimum radial clearance is retained between the tips of the flaps and the inner wall 9 of the downstream annular member 1*b* as a consequence of the partly spherical shape of the latter as previously described.

The fixed part 27*a* of each arm comprises a metal tie rod 37 each tie rod 37 being covered by a sheath 38 and a skin 39 on the upstream side and a skin 40 on the downstream side which may be of metal or of a composite material. The head 37*a* of each tie rod 37 is fixed by means of a pin 41 between the two forks 1*e* supported by the outer shell 1 at one of the bosses 3. The foot 37*b* of each tie rod 37 is located in the upstream bore 14 of one of the inserts 13 of the hub 12, and has at its end a threaded part 37*c* co-operating with a tightening nut 42.

In assembly of the intake housing described above, the radially outer end of the fixed part 27*a* of each casing arm 27 is first of all inserted into a recess 1*c* of the inner face of the upstream annular member 1*a*. The tie rod 37 slides into the assembly until its head 37*a* is located between the two forks 1*e* to which it is fixed by the pin 41. A nut 42 is then screwed on the foot 37*b* of each tie rod without clamping. All the fixed parts 27*a* of the arms 27 and all the tie rods 37 are thus mounted in succession between the upstream annular member 1*a* and the hub 12. Then, the movable flaps 27*b* are successively placed in position, the inner pivots 28 and the outer pivots 29 of the flaps being respectively placed in the downstream openings 15 of the inserts 13 of the hub 12 and in the half-bosses 10 of the upstream annular member 1*a*. The upstream and downstream members 1*a* and 1*b* are then connected at their respective flanges 5 and 6, the half-bosses 11 of the downstream member 1*b* enclosing the outer pivots 29 and bushings 30 of the movable flaps 27*b*. The nuts 42 are then tightened in such a manner as to obtain a pre-stressing of the tie rods 37. Independently, the inner cover 23 is also fixed to the disc 22 of the rotor. The intake housing assembly is then connected to the casing of the turbine plant by means of their co-operating flanges, taking care to fit correctly the sealing blades 25 and 26 of the cover 23 into the corresponding grooves 18 and 20 of the hub 12.

Figure 3A:
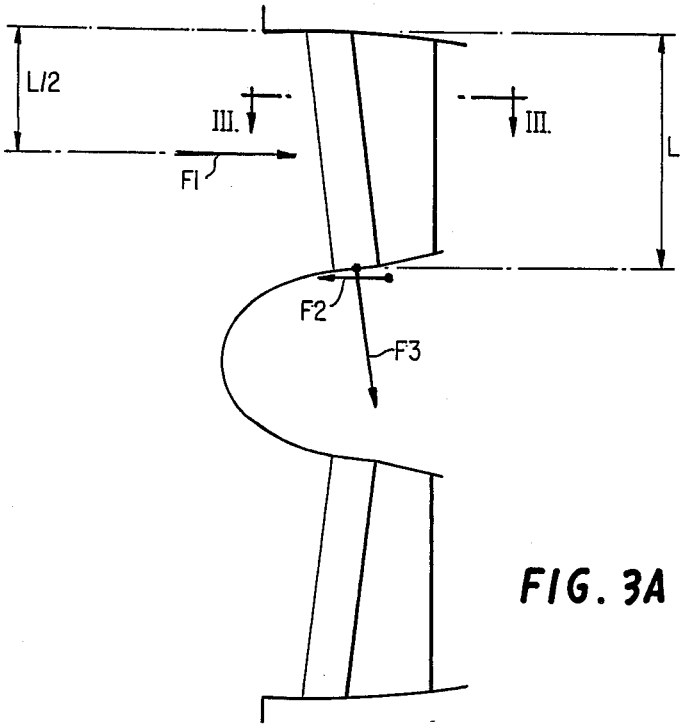
FIG. 3*a* is a diagrammatic axial sectional view of the intake housing showing the distribution of the stresses exerted on an arm of the housing; and, FIG. 3*b* is a diagrammatic sectional view through one of the arms and taken along the line III—III in FIG. 3*a*.
Figure 3B:
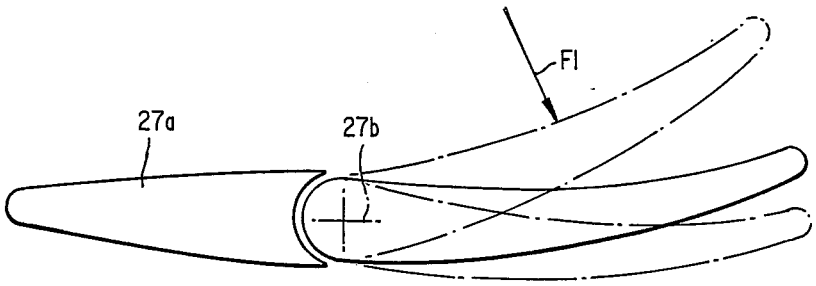

A diagrammatic representation is shown in FIGS. 3*a* and 3*b* of the stresses exerted on the intake housing during operation. F1 represents the aerodynamic stress exerted on the movable flaps 27*b*. The pre-stressing obtained by the above-mentioned tightening of the nuts 42 fixing the tie rods 37 may be broken down into an axial component F2 and a radial component F3. The radial component F3 of the pre-stress is absorbed by the coiling 16 of the inner hub 12, and the axial component F2 is absorbed by the movable flaps 27*b*. This pre-stress component F2 is in a direction opposite that of the stress F1 and thus partly compensates, in operation, the aerodynamic stress F1. Depending on the level of pre-stressing applied to the tie rods 37, it will be possible, for example, to achieve a compensation $F_2 = F_{\frac{1}{2}}$.

Other additional features may be incorporated in the intake housing in accordance with the invention. For example, on either side of each tie rod 37 an electric resistor may be placed in the sheath 38, as shown at 43 and 44 on the upstream and downstream sides of the rod respectively in FIG. 1. Connections 43*a* and 44*a* of these resistors may be located in the cap 4, connecting them to incoming electric leads 45 and 46. These elements form an electrical de-icing system for use depending on the conditions of operation of the turbine plant, and is particularly useful in aeronautical applications.

Obviously, numerous modifications and variations of the present invention are possible in light of the above teachings. It is therefore to be understood that within the scope of the appended claims, the invention may be practiced otherwise than as specifically described herein.

What is claimed is:

1. A twin-flow turbine plant having an air intake housing of the type mounted in cantilever fashion, comprising:

an inner hub, an outer shell surrounding and radially spaced from said inner hub, and a plurality of arms extending radially between said inner hub and said outer shell, each of said arms comprising a fixed part, an associated adjustable flap, wherein each of said arms includes a metal tie rod forming a central core and disposed between said inner hub and said outer shell, and a nut fixing said tie rod to said inner hub whereby said tie rod is prestressed by the tightening of said nut wherein said inner hub is of a floating type; being supported by said tie rods, and comprises superimposed layers of coiled filaments of composite material, and a plurality of metal inserts embedded in said superimposed composite filament layers, each of said tie rods co-operating with one of said inserts.

2. A turbine plant intake housing according to claim 1, wherein each of said arms has a convexly curved side and an opposite concavely curved side, and wherein each arm includes a sheath of composite material surrounding said metal tie rod, and a skin of composite material covering said sheath on said curved sides of said arm.

3. A turbine plant intake housing according to claim 1, wherein each of said arms has a convexly curved side and an opposite concavely curved side, and wherein said each arm includes a sheath of composite material surrounding said metal tie rod, and a metal skin covering said sheath on said curved sides of said arm.

4. A turbine plant intake housing according to claim 1, including means rigidly connecting each of said tie rods to said outer shell, said means comprising two forks supported by said outer shell, a head at the radially outer end of said tie rod located between said forks, and a pin rigidly connecting said head of said tie rod to said forks.

5. A turbine plant intake housing according to claim 1, wherein said inner hub has upstream and downstream lips each provided with a seal receiving groove, and a cover fixed to the disc of the fan rotor of said twin-flow turbine plant, said cover carrying sealing blades located in said grooves in said upstream and downstream lips.

* * * * *